United States Patent [19]

Terrero

[11] 4,378,115

[45] Mar. 29, 1983

[54] BASEBALL GAME

[76] Inventor: Manuel Terrero, 911 Walton Ave., Apt. Supt., Bronx, N.Y. 10452

[21] Appl. No.: 230,745

[22] Filed: Feb. 2, 1981

[51] Int. Cl.[3] ..... A63F 3/00

[52] U.S. Cl. ..... 273/93 C

[58] Field of Search ..... 273/93 R, 93 C, 94, 273/88

[56] References Cited

U.S. PATENT DOCUMENTS 1,113,504 10/1914 Steele ..... 273/93 R

OTHER PUBLICATIONS

Washington Post, 9-30-73, p. D-1.

*Primary Examiner*—George J. Marlo

*Attorney, Agent, or Firm*—Richard L. Miller

[57] ABSTRACT

A baseball game having a gameboard on which is provided a baseball diamond. Playing pieces are utilized and are representative of individual baseball players representing two teams. A scoring pad is included to keep records of the activities of the players. Three dice are utilized as a chance determining device to produce a random output count number which is then looked up in a particular table representing the status of the activities during that inning and from the table specific game information is determined. A separate table is provided for each combination of the number of outs in an inning and the number of runners on base. In order to provide rapid access, the tables may be stored in the memory of a computer. The computer includes a first input for entering the output count; a second input for entering the number of outs, the number of runners on base, and the number of innings; and a display for indicating information corresponding to the output number entered and the number of outs and runners on base. In the accompanying appendix there are provided 23 tables for the 23 different inning situations, with a total of 56 possible numeric combinations on each table corresponding to the 56 possible combinations available.

7 Claims, 2 Drawing Figures

BASEBALL GAME

BACKGROUND OF THE INVENTION

This invention relates to a game of chance and more particularly to a game involving the rules of baseball.

Numerous types of games of chance are presently available. With such games, a chance determining means, such as dice, roulette, etc. are utilized in order to determine the positioning of players on a gameboard, or such similar routine. One of the main requirements of a game is that it be designed so as to keep the interest of the players.

In many sports games it is the desire of the game to try and duplicate as closely as possible the true situations occurring in the sport. For example, in baseball games, the game should try and duplicate the various types of hits, strategies and various events that occur during the course of a game. The problem with such baseball games is that the number of variations, permutations, and different situations is so great that it is generally impractical, if not actually impossible, to duplicate the actual baseball situation in a game.

For example, the variations involved when a first hitter comes at bat is that he could get one or various types of hits, strikeouts, fly out, or numerous other types of variations. For example, even the particular hit could be to any of various places on the playing field; it could be a bunt, or he might get on base as a result of a wild pitch. Furthermore, until he completes his turn at bat there may be a number of balls and strikes involved.

The situation gets further complicated when second and subsequent players get at bat. Each of their possibilities becomes multiplied by the achievement of the previous batter. For example, the second batter has different options depending upon whether there are men on base, and if so which bases, depending upon how many outs there are, and if so the number of outs, and numerous other variations.

At present, most games which try to use a baseball theme for the game, has a limited number of moves and possibilities for the playing pieces and accordingly, lacks the thrill and excitement of a true baseball game and accordingly, fails to maintain the full interest and attention of the players.

SUMMARY OF THE INVENTION

Accordingly, it is an object of the present invention to provide a game of chance, utilizing a baseball theme and which avoids the aforementioned problems of prior art games.

Another object of the present invention is to provide a baseball game which closely simulates the true action and excitement of an actual baseball game.

Still another object of the present invention is to provide a baseball game which has a complete, thorough, and detailed list of possible occurrences of baseball action depending upon the previous events of the particular inning.

A further object of the present invention is to provide a game of chance utilizing true baseball action as the theme of the game, and permitting the players to have an almost unending list of variations and permutations, possible so as to closely simulate the true action of a baseball game.

Briefly, in accordance with the present invention, there is provided a game including a gameboard on which there is formed a baseball diamond. A plurality of playing pieces are distinctively identified to form two teams of individual baseball players. A scoring pad is provided on which the individual scores of the players are indicated as well as their previous records and averages. A chance determining device is provided which produces a random output count in positive integers of numbers in a base seven system. There is also included a table lookup which provides specified game information corresponding to each output count.

In a particular embodiment of the invention, the chance determining device includes a plurality of individual gaming pieces and in such situation the output count always has a corresponding number of digits equal to the number of individual gaming pieces. In an embodiment of the invention, a computer can be included for storing the table lookup and the particular specified game information will be displayed from the computer.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWING

In the drawing.

In the various figures of the drawing, like reference characters designate like parts.

DESCRIPTION OF THE PREFERRED EMBODIMENT

Figure 1:
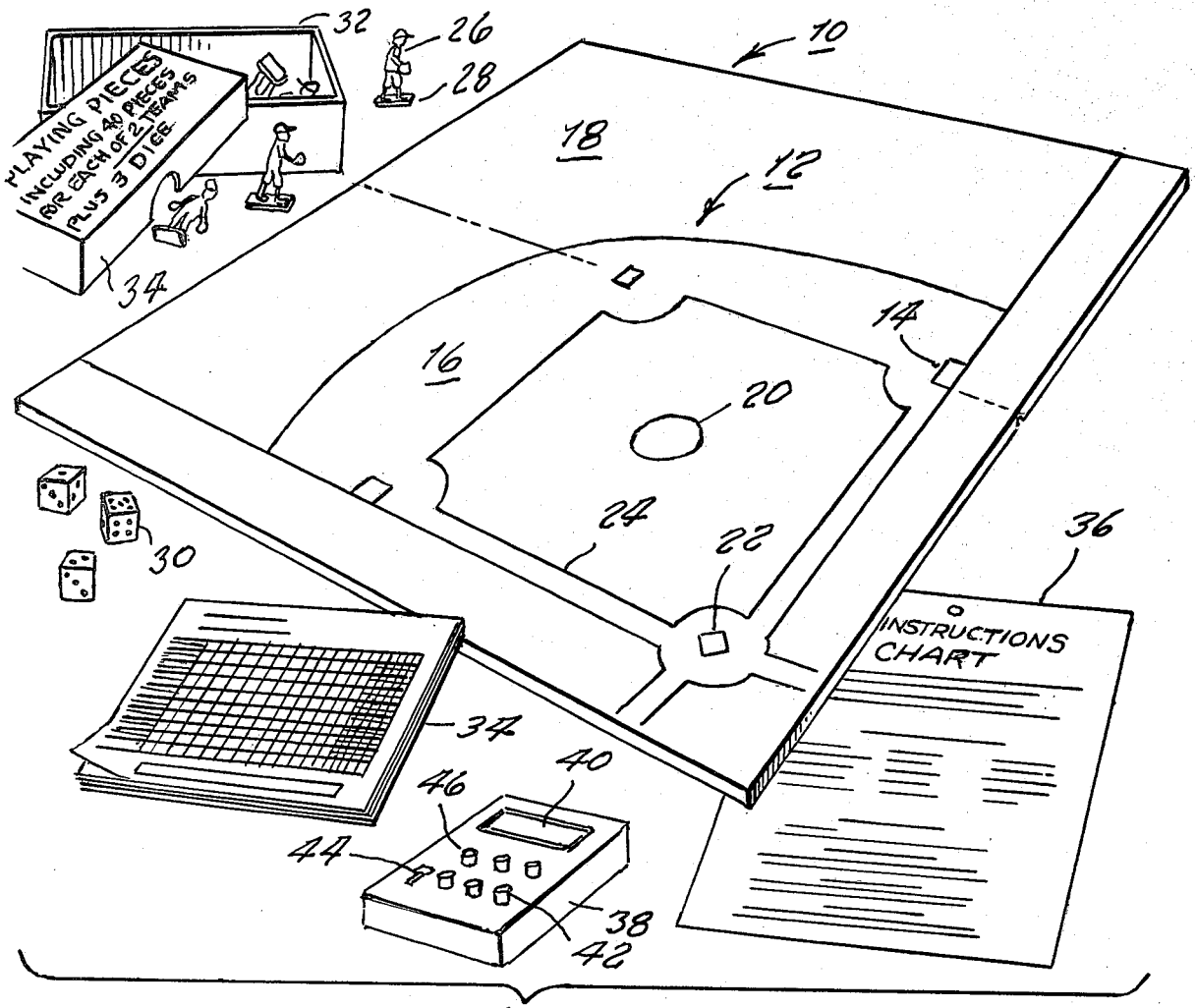
FIG. 1 is an exploded view showing the various component parts in accordance with the present invention.

Referring now to FIG. 1, the present game includes a gameboard shown generally at 10 upon which is formed a baseball diamond shown generally at 12. The baseball diamond includes the usual bases 14, infield 16, outfield 18, pitchers mound 20, homeplate 22, and running lanes 24. The layout is such as to substantially duplicate an actual baseball playing field.

Also included are a number of playing pieces 26 each in the form of a baseball player, and mounted on a base 28 such that the playing piece can be suitably positioned on various locations of the baseball playing field. The playing pieces 26 are divided into two teams and are distinctively identified into the two teams by means of different color pieces or other such designations. The playing pieces can each be identical in shape or, alternately, can each be formed into a shape and position to represent a particular type of player such as a catcher, baseman, fielder, etc.

Three dice 30 are also included. Each of the dice include the usual sequence of numbers from one to six on its various sides. For convenience, a box 32 can be provided with a cover 34 in which is stored the various playing pieces and the three dice. Typically, a total of 40 playing pieces will be inlcuded with 20 for each team.

A scoring pad 34 is included on which there are a number of scoring sheets, to be hereinafter described. There is also included an instruction chart 36 which can include all of the tables as will hereinafter be described. A computer 38 can be optionally included. The computer can be any type which includes a storage medium and a display 40. Three input keys 42 are provided to enter three numbers as will hereinafter be explained, and an ON-OFF switch 44 is placed on the computer. The actual computer can be any of the well known storage devices which will display an output corresponding to a given input in accordance with information stored in the storage medium. Such computers, or calculators, are well known in the art.

As is well known, the type of event that can occur in a baseball game often depends upon the state of the inning. For example, with bases empty and nobody out, a batter may decide to try for a hit. However, if there is a runner on one of the bases, the batter may sacrifice in order to advance the runner. Furthermore, the events that occur may differ depending upon whether nobody is out or whether there are already two outs in the inning. The present game accommodates for all these variations. At the same time, it gives sufficient variations in occurrences of baseball events to maintain interest in the game.

The game is played by having each player throw the dice. The numbers that come up on the dice occur by chance and accordingly the dice represent a chance determining device. The numbers on each dice are positive integers and form numbers within a base 7 system due to the fact that they go up to a maximum of 6.

Accordingly, with three dice, three positive integers are provided. Each of these numbers are within the base seven system. By taking the lowest number first, then the second lowest and finally the highest number, a total three digit number in the base seven system formed of positive integers can be obtained.

For example, if the lowest number on the three dice is a 1, a second dice has the number 2, and the third dice displays the number 3, the number represented will be 123. If the numbers are 5, 3, and 6, they would be read as 356. If two numbers are the same, as for example the numbers 5, 5, and 2, they would be read as 255.

For each number, there is an entry provided on a table lookup in accordance with the particular instance in the inning. For example, a first table would be provided for the situation of "bases empty, nobody out." Another table would be provided for the situation of "bases empty, one out." Other tables would be provided for the situation of "bases empty, two outs," "runner on first, nobody out," "runner on first, one out," "runner on second, nobody out," "runner on third, two out," "runners on first and third, one out," "runners on second and third, one out," "bases loaded, nobody out," etc. Specifically, for each of the situations of bases empty, runners on each of the bases, runners on combinations of two of the bases, and runners on all three of the bases, there will be a separate table for a respective one of the situations where there are no outs, one, or two outs.

On each table, there will be provided a series of the numbers from 111, 112, . . . 666, with the numbers increasing in positive integers in the base seven system. It should be noted, that since only positive numbers are utilized zero will not occur in the numbering system.

In the accompanying appendix, there is provided all of the 23 tables for the 23 different inning situations, with a total of 56 possible numeric combinations on each table corresponding to the 56 possible combinations available using the three dice in accordance with the aforementioned sequence.

The attached tables provided in the appendix can be included on the instruction chart 36 provided with the gameboard. Alternately, this information can be stored in memory in the computer 38. When utilizing the computer, the number provided by the three dice would be keypunched to the computer by utilizing the keys 42. The computer would determine the corresponding table and utilize the table to determine the instruction and then display the instruction in the display 40. In order to determine the proper table the computer would keep a tally of the number of outs in each inning, the number of players at bat, and the number of runners on each base. Alternately, additional switches or keys 46 could be provided in order to input the number of outs, the number of runners on base, and the number of innings. The particular circuitry involved is such as is well known in the art, and is easily constructed by one skilled in the art.

Figure 2:
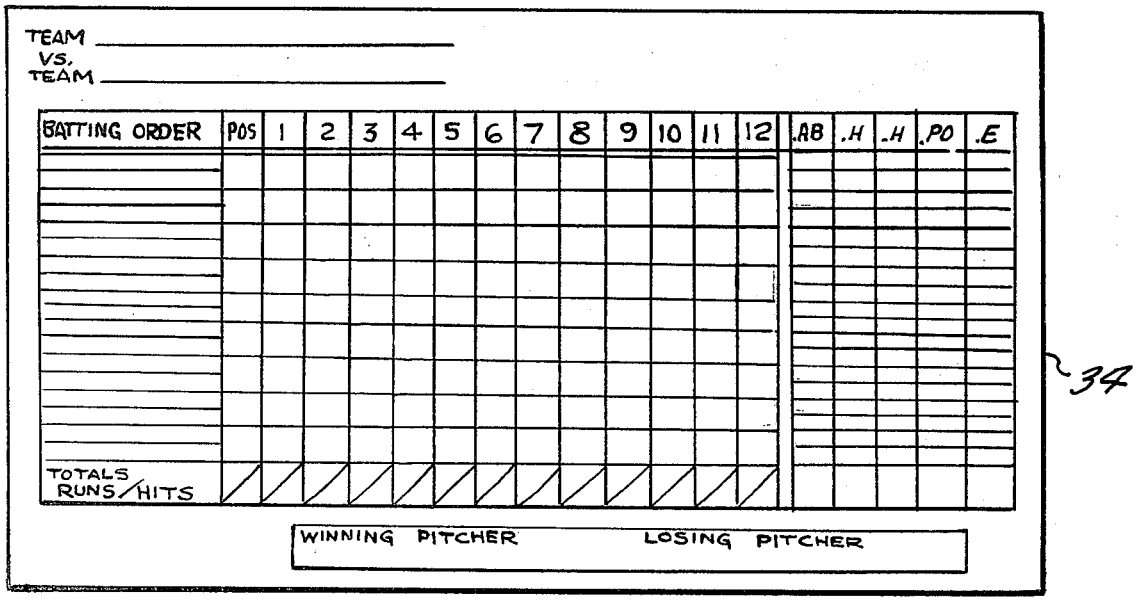
FIG. 2 is an enlarged view of a single sheet from the scoring pad shown in FIG. 1.

In order to start the game, each player can throw out one of the dice and the player with the highest number is the first at bat. In order to utilize the scoring pad, each scoring sheet can have a layout as shown in FIG. 2. The scoring sheet includes indicia on which can be written the names of the two teams which are playing. Then, the batting order can be listed on the left hand column. The position of each player can then be identified and thereafter each of the various times that the individual is at bat is entered in an appropriate column in which is indicated the particular activity that the batter achieved during his time at bat.

In order to simplify the utilization of the scoring sheet, the following set of symbols can be utilized in the baseball game:

| | | |
|---|---|---|
| 1—Pitcher | 4—Second Baseman | 7—Left Fielder |
| 2—Catcher | 5—Third Baseman | 8—Center Fielder |
| 3—First Baseman | 6—Shortstop | 9—Right Fielder |
| K—Strikeout | —.Single | E—Error |
| BB—Base on Balls | =.Double | SB—Stolen Base |
| HR—Home Run | ≡.Triple | DP—Double Play |
| O—For Out | B-To Bunt the Ball | Sac—Buntin or Flying Out |
| HP—Hit by Pitcher | WP—Wild Pitcher | BK—Pitchers' Balk |
| PB—Passed Ball | | |

When entering the information on the scoring sheet, a single horizontal line on the lower right hand corner would indicate a single, two lines in the upper right hand corner would indicate a double, three lines in the upper left hand corner a triple, and a home run would be indicated in the lower left hand corner. The numbers would be placed in the center and would provide an indication as to where in the playing field the hit occurred.

In order to determine the team's record, the number of games won or lost can be determined as a ratio of the total number of games multiplied. This can be converted into a percentage. Similarly, each individual batter's record can be determined. Usually, this is done by determining the number of hits divided by the number of times at bat. This ratio can also be converted to a percentage. Typically, instead of converting to a percentage, the number is divided by 1,000 and this number is utilized in typical baseball fashion.

Similarly, the record of each individual pitcher can be determined. The number of runs is determined and divided by the total innings pitched completely by a particular pitcher. Then, the result is multiplied by nine in order to determine the efficiency of the completed games. In order to record the number of wins and losses of each pitcher, the number of games won is multiplied by 1,000 and the result is divided by the number of games pitched.

In order to make the game more reminiscent of an actual baseball game, particular names of pitchers can be entered on the scoring card and particular names of teams can be entered directly on the particular playing pieces. In this way, leagues can be set up, and entire series can be played.

There has been disclosed heretofore the best embodiments of the invention presently contemplated. However, it is to be understood that various changes and modifications may be made thereto without departing from the spirit of the invention.

APPENDIX

BASES EMPTY, NOBODY OUT

111.—Deep into left field, going, going and gone, a home run at the 380 feet mark.
112.—Outside and low ball.
113.—Strike called.
114.—Round ball to the pitcher, throws to 1st, out.
115.—Line to ss., jumps and what a beautiful catch, out.
116.—Round ball to 1st base, takes it step on base, and makes the out.
122.—Line shot to left field, base hit.
123.—Outside ball.
124.—Swing and a miss, strike.
125.—Hard rolling to ss., the ball gets away between the legs (error).
126.—Fly ball to the infield, 3rd baseman calls for it and makes the out.
133.—Batter bunt the ball to 3rd base, 3rd baseman is left with ball in hand, base hit.
134.—Inside, ball.
135.—Foul ball to the right field line.
136.—High fly to center field, waiting and makes the catch.
144.—Round ball to 3rd, ball goes thru the hole, base hit.
145.—High foul fly to the catcher, under the ball, waiting and makes the out.
146.—Low in the dirt, ball.
155.—Deep line to left field, going back, going back and makes the catch.
156.—Swing and a miss, strike. What a swing that was.
166.—High, ball.
222.—Line shot to left center, ball goes one hup to the wall, is a stand-up double.
223.—Foul fly to the stands.
224.—Low, ball.
225.—Deep line to center field, going back, going back, and makes the catch against the wall.
226.—Strike called, a fast ball.
233.—Round ball up the middle, base hit to center field.
234.—Low, ball.
235.—Strike called.
236.—Round ball to 3rd, takes it throws to 1st, out.
244.—Base hit to the left field line, ball goes all the way to the wall, and is a stand-up double.
245.—Hard rolling to ss., takes it, throws to 1st, out.
246.—Line to center field and makes the out.
255.—Wild pitch.
256.—Swing and a miss, strike.
266.—Fly ball to left field, waiting and makes the out.
333.—Line shot to right center, ball goes one hup to the wall, runner trying for 3 and is safe A triple.
334.—Outside, ball.
335.—Fly ball to right field, waiting and makes the catch.
336.—Line to left field, 4 steps forward and makes the catch.
344.—Round ball to 2nd, takes it, throws to 1st, a bad throw, runner move to 2nd, error.
345.—Hit by the pitch, dead ball, runner goes to 1st base.
346.—Foul fly to left field, here comes the right fielder and makes the catch.
355.—Slow round ball to ss., he throws to 1st, safe, infield hit.
356.—Hard rolling to ss., takes it, throws to 1st, out.
366.—Short fly to center field, it looks good, looks good, is a base hit.
444.—Long fly to left field, going, going and gone, a home run.
445.—High, ball.
446.—Batter bunt the ball, a faul ball.
455.—Round ball to 1st, takes it, throws to the pitcher, he drops the ball, safe, an error.
456.—Time called by the chief umpire, to clean home play.
466.—Hard line to the pitcher and takes it for the out.
555.—Line shot to right field line, ball goes all the way to the wall, runner trying for 3, and is safe, a triple.
556.—Fly to the infield, 1st baseman calls for it and makes the out.
566.—Low in the dirt, ball.
666.—Deep long fly to center field, going back, going back and is gone, a home run at the 411 feet mark.

BASE EMPTY, ONE OUT

111.—Deep fly to left, going, going, hit against the wall, is a double.
112.—Outside, ball.
113.—Strike called. Swinging.
114.—Line to center field and capture (out).
115.—Rolling to 2nd, long throw to 1st, out.
116.—High, ball.
122.—Hard rolling to left (hit).
123.—Strike called, strike out.
124.—Low, ball.
125.—Rolling to 2nd, throw at 1st, out.
126.—Strike, swinging.
133.—Line drive to center (base hit).
134.—Inside, ball.
135.—Rolling to 1st, pitcher comes to cover, the throw and is out.
136.—Fly to center, waiting and got it (out).
144.—Hard line to right field (base hit).
145.—Wild pitch.
146.—Strike called.
155.—Rolling to 3rd, a bad throw, safe (error).
156.—Fly to right field, out.
166.—Dead ball, batter goes to 1st.
222.—Rolling to 3rd, a bad throw, batter goes to 2nd (error).
223.—Strike called, swinging.
224.—Line to 2nd baseman hand, out.
225.—Slow rolling to third, and foul it is.
226.—Deep fly to left, going, going, left fielder jump and got the ball.
233.—Strike swinging, 3rd strike (out).

234.—Fly to center, waiting, waiting and he drops the ball (error).
235.—Rolling to 2nd, throws at 1st, out.
236.—Strike called.
244.—Line to right field, he drops the ball (error).
245.—Rolling to 3rd, throws at 1st, out.
246.—Fly to center field, waiting and capture (out).
255.—Line drive to left field line, ball goes to the wall, is a stand-up double.
256.—Strike called.
266.—Low ball, batter goes to 1st, walk.
333.—Line drive to right center field, ball goes to the wall and is a triple.
334.—Outside, ball.
335.—Line to 1st baseman, out.
336.—Short fly to right, it looks like itis going to drop for a hit, no, the right fielder got
344.—Rolling to 1st, is a base hit to right field.
345.—High, ball. Batter goes to 1st, walk.
346.—Slow rolling to 3rd, it looks like a hit, throw at 1st and is out.
355.—Line drive to right fielder, ball goes to the wall and is a triple.
356.—Rolling to the box, he drops the ball, takes it again, throws at 1st, out.
366.—Walk, batter goes to 1st.
444.—Deep line to right center, right fielder can't get to the ball, ball goes to the wall, bal get away from center and is an inside home run.
445.—Rolling to 3rd, takes it, throw at 1st, out.
446.—Deep into right field, going back, going back and got it, out.
455.—Foul ball to right field, waiting and he drops the ball.
456.—Rolling to center field, hit.
466.—Infield fly, short stop waiting and capture (out).
555.—Line to left field and is a double.
556.—Foul ball behind the catcher.
566.—High, ball.
666.—Long fly to left, going, going and is gone, foul ball at 350 feet mark.

BASE EMPTY, TWO OUT

111.—Deep line to right center, ball goes all the way to the wall, runner turning around 2nd base, going to 3rd, here comes the throw and is safe, triple.
112.—Strike called.
113.—Low, ball.
114.—Round ball to 3rd, takes it, throws to 1st, out.
115.—Fly ball to left field, waiting and makes the catch.
116.—Slow dribble to 3rd base, foul ball.
122.—Line shot to left field line, ball goes all the way to the wall, is a stand-up double.
123.—High, ball.
124.—Swing and a miss, strike.
125.—Hard line to the pitcher, he takes it for the out.
126.—Fly ball to center field, waiting and makes the catch.
133.—Hard line, base hit to center field.
134.—Round ball to ss., takes it, throws to 1st, out.
135.—Line drive to left field line, foul ball.
136.—Hard rolling to 2nd base, takes it, throws to 1st, out.
144.—Line shot, base hit to center field.
145.—Rolling to 1st base, takes it, steps on base and makes the out.
146.—Fly ball to right field, waiting and makes the catch.
155.—Outside, ball.
156.—Round ball to 3rd, takes it, throws to 1st, out.
166.—Wild pitch.
222.—Line shot to left field line, ball goes one hup to the wall, a stand-up double.
223.—Time called, batter steps out of the batting box.
224.—Hard round ball to 3rd base, takes it behind 3rd base, a long throw to 1st, out.
225.—Foul fly to short right field, 1st baseman goes for it and makes the catch.
226.—Swing and a miss, strike.
233.—High, ball.
234.—Round ball to 3rd, ball goes thru the hole, base hit.
235.—Line shot to left field, ss. jumps and makes the out, what a play.
236.—Hard rolling to 1st, takes it, runs, steps on base and makes the out.
244.—Short fly to center, it looks like it is going to drop for a base hit, and it is a base hit.
245.—Strike called.
246.—Round ball to ss., takes it, throws to 1st, out.
255.—Low, ball.
256.—Slow round ball to 1st, takes it, throws it to the pitcher and makes the out.
266.—Fly ball to left field, fielder goes 4 steps backward and makes the out.
333.—Deep hard line to right center, ball goes one hup to the wall, runner is going to 3rd and is safe, a triple.
334.—Round ball to 2nd, takes it, throws to 1st, out.
335.—Swing and a miss, strike.
336.—Line shot to 2nd base, takes it in a short bound, throws to 1st, out.
344.—Slow dribble to 3rd base, here comes 3rd baseman, takes it barehanded, throws to 1st, safe, infield hit.
345.—Outside, ball.
346.—Fly ball to right field, waiting and makes the catch.
355.—Line drive to left field line, foul ball.
356.—Round ball to 2nd, takes it, throws to 1st, out.
366.—Outside, ball.
444.—Deep fly to left field, going, going and gone, a home run.
445.—High fly to 3rd base, under the ball, waiting and makes the out.
446.—Swing and a miss, strike.
455.—Hard rolling to 3rd, takes it, throws to 1st, out.
456.—Line shot to right field, base hit.
466.—High ball, the 4th ball, a walk.
555.—Hard line to right center, nobody can get to the ball, ball hit the wall, and is a standup triple.
556.—Fly ball to center field, under the ball, waiting and makes the catch.
566.—Hit by the pitcher, dead ball, runner goes to 1st.
666.—Deep line into left field, going, going and gone, a home run, at the 380 feet mark.

RUNNER ON 1ST, NOBODY OUT

111.—Deep line to center field, going, going and gone, home run, 2 runs scored.
112.—Strike called.
113.—High, ball.
114.—Fly ball to center field, 1,2,3,4 steps forward and makes the catch.
115.—Round ball to 1st, takes it, throws to 2nd, out, back to first, out, a double play.
116.—Swing and a miss, strike.

122.—Slow round ball to ss., throws to 2nd, safe, to 1st, safe. (fielder choice).
123.—Wild pitch, runner goes to 2nd base.
124.—Strike called.
125.—Hard round ball to 3rd, throws to 2nd, out, to 1st, safe.
126.—Outside ball, runner goes to 2nd, here comes the throw and is out.
133.—Line,base hit to left field, runners on 2nd and 3rd.
134.—Pitcher goes to 1st, out, they got him.
135.—Swing and a miss, strike.
136.—Fly ball to left field, waiting and makes the catch.
144.—Hard line to right field, base hit, ball gets away between the legs, runners on 3rd and 2nd.
145.—Rolling to the pitcher, throws to 2nd, out.
146.—Outside, ball.
155.—Round ball to 3rd, takes it, throws to 2nd, out.
156.—Strike called.
166.—Line base hit to right field, runner trying to go to 3rd, the throw and is out on 3rd base.
222.—Short fly to right field, it looks like a base hit, a base hit it is, ball gets away. Runners on 2nd and 3rd.
223.—Outside, ball, catcher throws to 1st, they got him out.
224.—Inside ball, runner goes to 2nd, the throw, but runner returns to 1st, safe.
225.—Batter bunt the ball, a perfect bunt, a base hit.
226.—Fly ball to left field, waiting and makes the catch.
233.—Slow round ball to ss., throws to 1st, out, runner moves to 2nd.
234.—Swing and a miss, strike, runner goes to 2nd, the throw and is safe, stolen base.
235.—Line, foul ball to left field.
236.—Pitcher throws to 1st, safe.
244.—Round ball to 2nd, ball hit the runner, he is out and a base hit for the batter.
245.—Line to 1st base, takes it, steps on the base, a double play.
246.—High, ball 4, a walk.
255.—Pitcher throws to 1st, they got the runner between bases, 1st baseman drops the ball and runner returns safe to 1st.
256.—Strike called.
266.—Slow round ball to ss., takes it, throws to 2nd, out.
333.—Deep into right center, ball hit the wall, batter is going to 3rd, the throw and is safe, a triple, 1 run scored.
334.—Round ball to 2nd, throws to ss., out, to 1st base, out, a double play.
335.—Foul fly to the catcher, under the ball, waiting and makes the catch.
336.—Outside, ball.
344.—Hard rolling to 1st, ball gets away between the legs, runners on 1st and 3rd.
345.—Strike called.
346.—High fly ball to the infield, 2nd baseman calls for it, waiting and makes the out.
355.—Pass ball, runner move to 2nd base.
Swing and a miss, strike.
366.—Strike called.
444.—Line shot to left field line, ball goes one hup to the wall, runner from 1st score, a stand-up double.
445.—Hit and run fails, catcher throws to 1st, out, swing and a miss, strike.
446.—Inside, ball.
455.—Short fly to center field, here comes center fielder and makes a beautiful shoestring catch.
456.—Round ball to 3rd, throws to 1st, out, runner move to 2nd.
466.—Line to left field, ss. jumps and makes a beautiful catch.
555.—Line, base hit to center, ball gets away from fielder, runner from 1st score and batter goes to 3rd.
556.—Strike called.
566.—Round ball to ss., throws to 2nd, out, to 1st, safe.
666.—Deep long fly to left field, going, going and gone, a home run, 2 runs scored.

RUNNER ON 1ST, ONE OUT

111.—Line drive to left field, ball goes all the way to the wall, a double, runners on 2nd and 3rd.
112.—Strike called.
113.—Inside, ball.
114.—Round ball to ss., throws to 2nd, out, to 1st, out, a double play.
115.—Pitcher moves to throw to 1st, but does not throw.
116.—Strike called, strike out.
122.—Line, base hit to center field, runners on 1st and 2nd.
123.—Swing and a miss, strike, ball gets away from the catcher but nobody moves.
124.—Pitcher throws to 1st base, got the runner out of base, out.
125.—Bunt the ball, a good sacrifice play, runner move to 2nd base.
126.—Batter is thrown out of the game for saying bad words.
133.—Line shot, base hit to right field, runner move to 3rd, runners on 1st and 3rd, bases.
134.—Strike called, strike out.
135.—Outside, ball.
136.—Rolling to the pitcher, throws to 2nd, out, to 1st, out, a double play.
144.—Slow round ball to 3rd, and he is left with ball in hand, runners on 1st and 2nd bases, infield hit.
145.—High, ball.
146—Long fly to left field, going back, going back, and makes the catch, runner does not move.
155.—Hard rolling to 1st, he bobbles the ball, takes it, steps on the base and makes the out.
156.—Line, foul ball to left field.
166.—Strike called, runner goes to 2nd, the throw and is out.
222.—Pitcher throws to 1st, a bad throw, runner move to 3rd base.
223.—Time out, conference between catcher and pitcher.
224.—Fly ball to center field, waiting and makes the catch, runner does not move.
225.—Line to 1st baseman, takes it, out, run and step on base, safe.
226.—Outside, ball, catcher throws to 1st and is out.
233.—Low, ball, runner goes, here comes the throw and is safe.
234.—Inside, ball.
235.—Strike called.
236.—Line to the pitcher, throws to 1st, out, a double play.
244.—Line shot to center, ball goes one hup to the wall, is a stand-up double, 1 run scored.
245.—Foul fly to the catcher, under the ball, waiting and makes the out.
246.—Swing and a miss, strike. Hit and run fail, runner is out on 2nd base.

255.—Line drive to right field and makes the catch.
256.—Swing and a miss, strike.
266.—Wild pitch, runner move to 2nd.
333.—Hit by the pitch, dead ball, runners on 1st and 2nd.
334.—Outside, ball, a pitch out, runner goes to 2nd and is out.
335.—Pitcher throws to 1st, safe.
336.—Fly ball to the infield, infield fly is called.
344.—Line shot, base hit to center field, runner from 1st move to 3rd, runners on 1st and 3rd.
345.—Outside, ball.
346.—Strike called.
355.—Bunt the ball to 3rd base, the throw to 2nd base and is out.
356.—Base hit to center field, runner from 1st is going to 3rd and is out. Batter moves to 2nd with the throw.
366.—Hard rolling to ss., takes it, throws to 2nd, out, to 1st, out, a double play.
444.—Deep long fly to left field, going, going and gone, a home run, 2 runs scored.
445.—Outside, ball, it almost got away from the catcher.
446.—Strike called.
455.—Round ball to 3rd, takes it, throws to 2nd, force out.
456.—Pitcher throws to 1st, safe.
466.—Fly ball to right field, waiting and makes the catch, runner does not move.
555.—Line shot to right center, nobody can get to the ball, ball hit the wall, is a stand-up triple, 1 run scored.
556.—Outside, ball 4, a walk.
566.—Strike called, strike out.
666.—Deep long fly to center field, going back, going back and makes the catch at the 411 feet mark.

RUNNER ON 1ST, TWO OUT

111.—Deep line to left field, ball hit the wall, is a stand-up double, runners on 2nd and 3rd.
112.—Round to ss., throws to 2nd, out, force out.
113.—Outside. ball, wild but runner does not advance
114.—Hit and run goes, batter struck out.
115.—Foul fly to left field, under the ball and he drops the ball.
116.—Strike called.
122.—Line shot, base hit to left field, runner on 1st and 2nd.
123.—Pitcher throws to 1st, safe.
124.—High ball.
125.—Round ball to 1st, takes it, steps on base and makes the out.
126.—Inside ball, runner goes to 2nd, the throw and is out.
133.—Slow dribble to 3rd base, infield hit, runners on 1st and 2nd.
134.—Swing and a miss, strike.
135.—High fly to the infield, catcher calls for it and makes the out.
136.—Inside, ball, too close to batter.
144.—Line shot, base hit to center field, runners on 1st and 2nd bases.
145.—Round ball to 3rd, takes it, throws to 2nd, out.
146.—Line drive, foul ball to the right field line.
155.—Hit by the pitch, dead ball, runners on 1st and 2nd bases.
156.—Low, ball.
166.—Hard line to ss. and makes the out.
222.—Base hit to right field line, ball goes all the way to the wall, is a stand-up double, runners on 2nd and 3rd bases.
223.—Strike called.
224.—Wild pitch, runner move to 2nd.
225.—High fly to right field, waiting and makes the catch.
226.—Outside, ball, runner goes to 2nd, the throw and is out.
233.—Base hit to center field, ball gets away, runner from 1st score, batter is going to 3rd and is out.
234.—Deep fly to center, going, going back, going back and makes the catch, runner tag up to 2nd, safe.
235.—Pitcher throws to 1st, safe.
236.—Swing and a miss, strike.
244.—Strike called, runner goes to 2nd, the throw, a bad throw, runner move to 3rd base.
245.—Slow round ball to ss., throws to 2nd, out.
246.—Pitcher throws to 1st, out, they got him.
255.—High, ball 4, a walk.
256.—Pitcher throws to 1st, they got him out.
266.—Inside, ball, too close to batter.
333.—Deep hard line to left center, ball hit the wall, 1 run scored, batter going to 3rd and is safe, a triple.
334.—Round ball to 2nd, takes it, throw to ss. and makes the out.
335.—Hard line to ss., jumps, knock down the ball, takes it, throws to 2nd, out.
336.—High foul fly to the catcher, under the ball, waiting and he drops the ball.
344.—Pitcher throws to 1st, a bad throw, runner move to 2nd.
345.—Strike called.
346.—High fly to left field, 3 steps backward and makes the out.
355.—Pass ball, runner move to 2nd.
356.—Inside, ball.
366.—Hard rolling to 2nd, ball hit the runner, he is out.
444.—Hard line to left field line, ball goes all the way to the wall, a stand-up double, runners on 2nd and 3rd.
445.—Round ball to 1st, takes it, steps on the bag and makes the out.
446.—Swing and a miss, strike, ball gets away from the catcher, runner move to 2nd.
455.—Short fly behind ss., it looks like a hit, ss. runs for it andwhat a catch, out.
456.—High, ball.
466.—Hard line to 2nd baseman and makes the out.
555.—Line shot to right center, ball goes all the way to the wall, runner going to 3rd and is safe, a triple, 1 run scored.
556.—Strike called.
566.—Outside, ball, runner goes to 2nd, the throw and is safe, stolen base.
666.—Deep line to right center, going, going and gone, a 2-run home run at the 385 feet mark.

RUNNER ON 2ND. NOBODY OUT

111.—Hard line to center field, ball goes one up to the wall, is a double. 1 runner score
112.—Rolling to 3rd. ball hit the runner, out. Hit for a batter.
113.—Pinch runner to 2nd.
114.—Strike called.
115.—Rolling to ss. hold the runner, throw to 1st. out.
116.—Pitcher goes to 2nd. safe.
122.—Rolling to right field, base hit. Runner from 2nd. score, runner on 1st. base.

123.—High, ball, 4 ball a walk.
124.—High fly to infield, infield fly out.
125.—Inside, ball.
126.—Rolling to ss. hold the runner, throw to 1st. out.
133.—Line, base hit to left field, runner hold to 3rd. Runners on 1st. & 3rd. bases.
134.—Line to the pitcher, throw to ss. is a double play.
135.—Strike called.
136.—We have pitcher warning up in the bull pen.
144.—Wild pitcher, the runner move to 3rd. base.
145.—Rolling to 2nd. throw to 3rd. out. Runner on 1st. base.
146.—Foul fly to catcher waiting and makes the catch.
155.—Hit by the pitch, Runners on 1st. & 2nd. bases.
156.—Swing and a miss, Strike.
166.—Low, ball.
222.—Line drive to left field, base hit. Runner from 2nd. score. Runner on 1st. base.
223.—Line to 3rd. base, out. Throw to 2nd. safe.
224.—Strike called.
225.—Round ball to the pitcher throw to 3rd. out runner from 2nd. Runner on 1st. base.
226.—High, ball.
233.—Solw dribble to ss. infield hit, runners on 1st. & 3rd. bases.
234.—Strike called.
235.—Foul fly behind 1st. going back, going back and catch the ball.
236.—Rolling to 2nd. throw to 1st. out. Runner move to 3rd. base.
244.—Line drive to right field, base hit. Runner from 2nd. score, runner on 1st. base.
245.—Pass ball, runner move to 3rd. base.
246.—Long fly to left field going back, going back and makes the catch. Runner tag-up to 3rd. base and is safe.
255.—Inside, ball.
256.—Foul tip, hit the catcher.
266.—Round ball to ss., hold the runner at 2nd. throw to 1st. out.
333.—Line to right center, ball goes all the way to the wall is stand-up triple.
334.—High fly to 3rd., under the ball waiting and makes the catch.
335.—Pitcher goes to 2nd., safe.
336.—Line, foul to left field.
344.—Line, base hit to center, runner trying to score, here comes the trow and is out. Batter goes to 2nd. safe.
345.—Outside, ball.
346.—Pitcher goes to 2nd., safe.
355.—Slow dribble to pitcher, he is left with ball in the hand, every body safe. Runners on 1st. & 3rd. bases.
356.—Fly to left field and makes the catch. Runner tag-up to 3rd. and is out.
366.—Outside, ball.
444.—Deep long fly to left field going, going and gone, home run. 2 runs score.
445.—Batter bunt the ball, catcher takes it, throw to 3rd. is out. Runner on 1st. base.
446.—Low in the dirt, ball. Runner no move.
455.—Batter bunt the ball, a perfect sacrifice play.
456.—Rolling to ss.hold the runner on 2nd., throw to 1st out.
466.—Line drive to ss., out, Run steps on 2nd. base, double play.
555.—Fly to center field catch, Runner tag-up to 3rd., a bad throw, runner score.
556.—Strike called.
566.—High, ball.
666.—Deep long fly to center field going, going and gone, a pair runs. Home run.

RUNNER ON 2ND, ONE OUT

111.—Line shot to right field line, ball goes one hup to the wall, runner from 2nd score, and is a stand-up double.
112.—Low in the dirt, ball, runner does not advance.
113.—Line to left field, ss. jump and got the ball, what a play, throws to 2nd, safe.
114.—Strike called.
115.—Round ball to 2nd, takes it, throws to 1st, out, runner goes to 3rd, the throw, safe.
116.—Line to 2nd, takes it for the out, step on base, double play.
122.—Base hit to center field, runner from 2nd trying to score, the throw to home play, safe
123.—Inside, ball.
124.—Strike called.
125.—Deep fly to left field, going back and makes the-catch, runner tag up for 3rd and is safe.
126.—Hard rolling to 3rd base, ball hit the runner, he is out, hit for the batter.
133.—Hard round ball to 2nd, ball gets away from 2nd baseman, runner from 2nd score.
134.—Strike called, catcher throws to 2nd, they got him, out.
135.—High, ball.
136.—Swing and a miss, strike, catcher throws to 2nd, safe.
144.—Short fly to left field, base hit, he throws to home play and is out, batter move to 2nd
145.—Strike called, runner goes to 3rd and is out.
146.—Pitcher goes to 2nd, safe.
155.—Fly ball to right field and makes the out, runner tag up to 3rd, here comes the throw and is out.
156.—Strike called.
166.—Outside, ball.
222.—Deep line to left center, ball hit the wall and scattered between the fields, runner is trying for 3 and is safe, a triple, 1 run scored.
223.—Swing and a miss, strike, they got the runner between bases and he is out.
224.—Time called, batter steps out the batting box.
225.—Fly to center field, under the ball and makes the catch.
226.—Inside, ball.
233.—Line, base hit to center, runner trying to score, here comes the throw and is out, runner on 1st.
234.—Deep fly to right field, going back, going back and makes the catch, runner tag up to 3rd, safe.
235.—Line to the pitcher, gets it, throws to 2nd, safe.
236.—Low, ball.
244.—Line shot to left field line, ball goes all the way to the wall, 1 run scored, a stand-up double.
245.—Swing and a miss, strike. Did you see that curve? What a curve that was.
246.—Rolling to ss., takes it, hold runner on 2nd, throws to 1st, out.
255.—Hit by the pitch, dead ball, runners on 1st and 2nd.
256.—Fly ball to left field, waiting and makes the catch, runner does not move.
266.—Round ball to 3rd, takes it, hold runner, throws to 1st, out.

333.—Line shot to right field line, ball goes all the way to the wall, runner score, a stand-up double.
334.—Fast ball, high ball.
335.—Line to 2nd baseman, out, throws to 2nd base, a double play.
336.—Foul fly to the catcher, under the ball and he drops the ball.
344.—Rolling to left field, base hit, runner from 2nd score.
345.—Strike called, catcher throws to 2nd, safe.
346.—Outside, ball.
355.—Line shot to center field, base hit, the throw to home play and runner stays in 3rd, bat batter goes to 2nd.
356.—High, ball.
366.—He bunt the ball to the pitcher, takes it, throws to 1st, out, runner hold at 2nd.
444.—Deep long fly to right field, going, going and gone, a home run at the 385 feet mark.
445.—Hit by the pitch, dead ball, runners on 1st and 2nd.
446.—Swing and a miss, strike.
455.—Line to 1st base, out, runner from 2nd does not move.
456.—Round ball to 3rd, ball goes thru the hole, base hit, 1 run scored, runner stays in 1st.
466.—Pinch batter comes to bat.
555.—Outside, ball, runner goes to 3rd, a bad throw and runner scores.
556.—Fly to the infield, 2nd baseman calls for it and makes the out.
566.—Strike called.
666.—Deep to center field, it's a homerun, what a shot, they'll be looking for the ball for a long time.

RUNNER ON 2nd, TWO OUT

111.—Line shot to left field line, ball goes all the way to the wall, runner score, a stand-up double.
112.—Strike called.
113.—Slow round ball to the pitcher, takes it, throws to 1st, out.
114.—Outside, ball.
115.—Line, foul ball to left field.
116.—Fly ball to right fielder, under the ball and makes the catch.
122.—Round ball up the middle, base hit, runner score.
123.—Swing and a miss, strike.
124.—Round ball to 2nd, takes it, throws to 1st, out, runner move to 3rd.
125.—Inside ball, catcher throws to 2nd, safe.
126.—Outside ball, ball gets away from the catcher, runner goes to 3rd.
133.—Line, base hit to right field, runner score, runner on 1st.
134.—Strike called, catcher throws to 2nd, out, they got him.
135.—High fly to left center, center field calls for it and makes the catch.
136.—Time called, batter steps out the batting box.
144.—Hard line to left center, ball goes all the way to the wall, is trying for 3 and is safe, a triple, 1 run scored.
145.—High fly to the infield, ss. goes 3 steps backward and makes the out.
146.—A short hup to 3rd, takes it, hold runner, throws to 1st, out.
155.—Outside ball, runner goes to 3rd, here comes the throw and is safe.
156.—Swing and a miss, strike.
166.—High, ball.
222.—Base hit to right field line, 1 run score, a stand-up double.
223.—Line shot to 1st base, he drops the ball, takes it, step on the bag and makes the out.
224.—Strike called.
225.—Batter steps out the batting box.
226.—Round ball to 2nd, throws to 1st, out.
233.—Base hit to center field, here comes the throw to home play and is out. Runner moves to 2nd
234.—Inside, ball.
235.—Pinch batter comes to bat.
236.—Round ball to 1st, takes it, steps on base and makes the out.
244.—Hit by the pitch, dead ball, runners on 1st and 2nd.
245.—Line shot to 3rd baseman and makes the out.
246.—Swing and a miss, strike.
255.—Line shot to 2nd baseman and makes the out.
256.—Strike called, runner goes to 3rd, the throw, safe, stolen base.
266.—Outside, ball, ball gets away from the catcher, runner moves to 3rd.
333.—Hard line to right center, ball hit the wall, runner is going to 3rd and is safe, a triple, 1 run scored.
334.—Short fly to center, here comes the center fielder and got the ball, a shoe string catch.
335.—Strike called.
336.—Round ball to 1st, takes it, throws to the pitcher, out.
344.—Line, base hit to center, runner score, runner on 1st.
345.—High, ball.
346.—Foul fly to catcher, under the ball and makes the out.
355.—Inside, ball, runner goes to 3rd, the throw, a bad throw, runner score.
356.—Swing and a miss, strike.
366.—Wild pitch, runner move to 3rd.
444.—Deep shot to right center, ball hit the wall and scattered between the field, runner is trying to score, here comes the throw, here comes the runner and is safe, an inside the park home run, 2 runs scored.
445.—Deep into center, going back, going back, turns around and got the ball, what a catch, runner tag up and is safe.
446.—Round ball to ss., takes it, throws to 1st, out, runner hold in 2nd.
455.—Pass ball, runner move to 3rd.
456.—Line shot to 2nd baseman, and makes the out.
466.—Short hup to 3rd base, throws to 1st, out, runner hold in 2nd.
555.—Deep shot to right center, ball hit the wall, runner is trying for 3 and is safe, a triple, 1 run scored.
556.—They call in another pitcher.
566.—Deep line to right field line, a foul ball.
666.—Deep fly to right center, going, going and gone, a home run at the 390 feet mark.

RUNNER ON 3rd., NOBODY OUT

111.—Line to left field line, ball hit the wall, is a stand up double, runner from 3rd. score.
112.—Foul tip.
113.—Outside, ball.
114.—Outside, ball, catcher throws to 3rd. out, they got him.

115.—Rolling to 3rd., ball hit the runner, he is out, hit for batter.
116.—Pitcher steps out the pitching box, he is very nervous.
122.—Line drive to center, base hit, runner from 3rd score.
123.—Swing and a miss, strike. Throws to 3rd., safe.
124.—Rolling to 1st., hold runner on 3rd., steps on base and makes the out.
125.—Short fly to right field, here comes the right field, got the ball, runner does not move.
126.—Line, foul ball to the left field line.
133.—Wild pitcher, runner from 3rd. score.
134.—Fly to center field, under ball and makes the out, runner tag up, he throws to home play and is out.
135.—Strike called.
136.—Rolling to ss. throws to home play, out, throws to 1st., safe.
144.—Line to right field, right field cannot get to the ball, is a stand-up double. Runner score.
145.—Fly ball to the infield, ss. waiting and makes the out.
146.—Line drive to 3rd., baseman makes the out, runner from 3rd. does not move.
155.—Long fly to center field, under the ball and makes the out. Runner from 3rd. tag up and is safe.
156.—Round ball to pitcher takes it, hold runner, throws to 1st., out.
166.—High, ball.
222.—Line to right field, ball goes all the way to the wall and is a stand up double, 1 run scored.
223.—Rolling to pitcher, he bobbles the ball and throws to 1st., out. Runner from 3rd. does not move.
224.—Fly ball to the infield, 2nd. baseman under the ball and makes the out.
225.—High, ball.
226.—Swing and a miss, strike.
233.—Line, base hit to center, runner from 3rd. score.
234.—Intentional walk.
235.—Rolling to 3rd., hold runner on base, throws to 1st., out.
236.—Pitch hitter to bat.
244.—Batter bunt the ball, a perfect squeeze play.
245.—Strike called.
246.—Line to center field, one hand catch the ball, runner does move.
255.—Low ball in the dirt, nobody moves.
256.—Fly to center field, and makes the catch, runner from 3rd. tag up, he throws and runner holds back at 3rd.
266.—Strike called.
333.—Line to right field, ball goes all the way to the wall, trying for 3 he throws and is a triple, 1 score.
334.—Another pitcher is being called.
335.—Line drive to ss. out, throws to 3rd., a double play.
336.—Strike called.
444.—deep fly to right field, going, going and gone, a pair of runs, home run.
445.—Fly to infield, here comes 1st. baseman and makes the out.
446.—Strike called.
455.—High ball, catcher throws to 3rd., a bad throw, runner from 3rd. score.
456.—Line drive to pitcher out, to 3rd., safe.
466.—Outside, ball.
555.—Line to center field, base hit, runner from 3rd. score, and batter goes to 2nd. for double.
556.—Hard rolling to ss. throws to home play, and is out, runner on 1st.
666.—Deep fly to right field, going, going and gone in the right field corner, a pair of runs, a home run.
566.—Strike called.

RUNNER ON 3rd., ONE OUT

111.—Line to right field line, ball goes all the way to the wall, runner from 3rd. score and is a double.
112.—Inside, ball.
113.—Strike called.
114.—Foul fly to the catcher, waiting and makes the out.
115.—Another pitcher comes out to warm up in bull pen.
116.—Line to 3rd. baseman out, step on base, safe.
122.—Line, base hit to center, runner from 3rd. score.
123.—Outside, ball.
124.—Swing and a miss, strike.
125.—Slow dribble to pitcher, throws to 1st., safe, runner from 3rd. does not move.
126.—High, ball.
133.—Rolling to 2nd., ball gets away, runner from 3rd. score, runner on 1st. base.
134.—Line to 3rd. baseman hand out, step on base out, a double play.
135.—Short fly to ss., waiting and makes the out.
136.—Swing and a miss, strike.
144.—Line, base hit to center, runner from 3rd. score.
145.—Fly to center field and makes the out, runner from 3rd. does not move.
146.—Low, ball.
155.—Hard rolling in the hole to ss. Hold runner, throws to 1st., safe, infield hit. Runners on 1st. and 3rd. bases.
156.—Swing and a miss, strike.
166.—Strike called, catcher throws to 3rd. and they got him between bases and they tag him. (out).
222.—Line to right field center, runner score. Batter has a stand-up double.
223.—Inside, ball.
224.—Pinch hitter to bat.
225.—Rolling to ss., throws to home and they got him out.
226.—Four ball, trying to bunt the ball.
233.—Outside ball, runner goes to home, safe.
234.—Inside, ball.
235.—Rolling to 3rd., ball hit the tunner, he is out, batter gets to 1st., hit.
236.—Fly to the infield, here comes 2nd. baseman and makes the out.
244.—Line drive to center, base hit, runner score.
245.—Strike called.
246.—Rolling to the pitcher, hold runner, throws to 1st., out.
255.—Line to 3rd. base, out, step on base and double play.
256.—Batter bunt the ball, a little fly to the pitcher, out.
266.—High, ball.
333.—Line drive to right center, nobody can get to the ball, batter is trying for 3rd. and is safe, triple.
334.—Strike called.
335.—Line to the pitcher and makes the out, throws to 3rd., a double play.
336.—Pitcher goes to 3rd., safe.
344.—Slow dribble to 1st., infield hit, runner from 3rd. score.
345.—High, ball.

346.—Fly to infield, here comes 2nd. baseman and makes the out.
355.—Rolling to 1st., ball gets away between the legs-(error), runner from 3rd. score.
356.—Line to right field, and makes the out, nobody move.
366.—Outside, ball.
444.—Deep fly to left field going, going and gone, a home run, 2 runs homer.
445.—Line to 2nd. baseman, out. Runner return to 3rd., safe.
446.—Swing and a miss, strike.
455.—Hard line to left field, base hit, runner from 3rd. score.
456.—High fly to the catcher, waiting and makes the out.
466.—High, ball.
555.—Swing and a miss, strike.
556.—Short fly to center, it looks Texas and he got the ball at shoe string catch. Runner does not move.
566.—Deep fly to left field line, going, going, foul ball.
666.—Deep fly to center, going, going and gone, homer, run by the 411 feet mark.

RUNNER ON 3rd., TWO OUT

111.—Hard line to right field line, ball goes one hup to wall. Runner from 3rd. score, and is double.
112.—Inside, ball.
113.—Time called, conference between pitcher and catcher.
114.—Strike called.
115.—Deep fly to right field, going, going back and makes the out.
116.—Low, ball.
122.—Base hit to left field, runner from 3rd., score.
123.—Foul fly to right field, here comes right field, under the ball and makes the catch.
124.—Line to ss., he drops the ball, takes it, throws to 1st.
125.—Line, foul ball to the stand.
126.—High, ball.
133.—Line, base hit to left field, runner from 3rd. score.
134.—Fly ball to center, 1, 2, 3, steps backward and makes the catch.
135.—Swing and a miss, strike.
136.—Line drive to 1st. baseman and makes the out.
144.—Line drive to left center, runner from 3rd. score, batter goes to 2nd. base, is a double.
145.—Outside, ball.
146.—Line, to the pitcher and makes it out.
155.—Round ball up the middle to center field, base hit, runner from 3rd. score.
156.—Strike called.
166.—Fly, foul to left field, under the ball and makes the out.
222.—Hard line to right center, ball goes one hup to the wall, runner from 3rd. score, trying for 3 and is safe, triple.
223.—Hard rolling to 3rd., takes it, throws to 1st., out.
224.—Hard line to 3rd., he drops the ball, batter goes to 1st., runners on 1st. and 3rd. bases (error).
225.—Pitcher steps out the pitching box.
226.—Rolling to ss., takes it, throws to 1st., out.
233.—Pass ball, runner from 3rd. score.
234.—Line, base hit to right field, runner from 3rd. score.
235.—Foul fly to catcher, waiting and makes the out.
236.—Rolling to 1st., takes it, steps on bag and makes the out.
244.—Bunt the ball, a perfect squeeze play, runner from 3rd. score.
245.—Line to 2nd. baseman and makes the out.
246.—Pinch hitter comes to bat.
255.—Hit by the pitcher, dead ball, runners on 1st. and 3rd. bases.
256.—Balk, runner from 3rd. score.
266.—They calling in another pitcher.
333.—Slow dribble to 1st., infield hit, runner on 3rd. score.
334.—Swing and a miss, strike.
335.—Rolling to 2nd., takes it, throws to 1st., out.
336.—Deep fly to left field line, going, going and gone (foul ball).
344.—Wild pitch, runner from 3rd. score.
345.—Foul tip.
346.—Hard line to pitcher, out.
355.—Fly to center field, under the ball and makes the catch.
356.—Slow dribble to 3rd., throws to home play, safe. A base hit.
366.—Outside, ball.
444.—Deep fly to left, going, going and gone, a home run, 2 runs homer.
445.—Rolling to ss. takes it, throws to 1st., out.
446.—Batter steps out the batting box. Time out.
455.—Hard line to right field, base hit, runner from 3rd. score.
456.—Swing and a miss, strike.
466.—Rolling to 1st., takes it, step on bag and makes the out.
555.—Hard line to right center, ball goes all the way to the wall. Runner from 3rd, score, and is a stand-up triple.
556.—Low in the dirt, ball.
566.—Swing and a miss, strike.
666.—Deep line to center field, going back, going back, jump and got the ball. Oh! What a tremendous catch.

RUNNERS ON 1st & 2nd, NOBODY OUT

111.—Line shot to left field line, ball goes to the wall, runner from 2nd score, a stand-up double, runners on 2nd and 3rd.
112.—High, ball.
113.—Line to 2nd baseman and makes the out, runners do not move.
114.—Pitcher steps out the pitching box.
115.—Fly ball to center field and makes the catch, runner tag up to 3rd, safe, runners on 1st and 3rd.
116.—Strike called.
122.—Base hit to right field, the throw to home play, out, runners move to 2nd and 3rd.
123.—Outside, ball.
124.—Line shot to 2nd baseman, out, throws to ss., double play.
125.—Fly to the infield, infield fly out.
126.—Round ball to ss., throws to 2nd, out, goes to 1st, double play, runner from 2nd goes to 3rd
133.—Line base hit to center, runner from 2nd score, runners on 1st and 3rd.
134.—Swing and a miss, strike.
135.—Inside, ball.
136.—Outside ball, catcher goes to 1st and he got him out.
144.—Line drive to left field, base hit, runner from 2nd score, runner from 1st is out at 3rd.

145.—Strike called, runner from 2nd is out at 3rd, runner from 1st is out at 2nd.
146.—Strike called.
155.—Wild pitch, runners move to 2nd and 3rd bases.
156.—They call in another pitcher.
166.—Inside, ball.
222.—Line to right field line, ball goes all the way to the wall, 2 runners score, a stand-up double.
223.—Hit by the pitch, bases loaded.
224.—Batter bunts the ball, the throw goes to 3rd and is out.
225.—Line, foul ball to left field stand.
226.—Strike called.
233.—Base hit to the left field, runner from 2nd score, runner from 1st is out at 3rd, runner on 1st.
234.—Wild pitch, runners move to 3rd and 2nd bases.
235.—Fly ball to left field, waiting and makes the catch, runners do not move.
236.—Rolling to 1st, throws to 2nd, out, back to 1st, double play, runner on 3rd base.
244.—Hit by the pitch, bases loaded, no one out.
245.—Bunt the ball, a short fly to pitcher, throws to 2nd, out, a double play, runner on 1st.
246.—Rolling to ss., throws to 3rd, force out.
255.—Pitcher goes to 2nd, safe.
256.—Swing and a miss, strike, catcher throws to 2nd and they got him out, runner on 1st.
266.—
333.—Line shot to right center, ball goes to the wall, trying for 3rd and is a triple, 2 runs scored.
334.—Rolling to 3rd, throws to 2nd, out, to 1st, out, a double play, runner on 3rd.
335.—Strike called.
336.—Foul fly to catcher, under the ball waiting and makes the out.
344.—Slow rolling to 3rd, 3rd baseman is left with ball in hands, everybody safe, bases loaded
345.—Bunt the ball, a perfect bunt, everybody safe, bases loaded.
346.—Rolling to the pitcher, throws to 2nd, out, throws to 1st, out, a double play, runner on 3rd
355.—They call in a new pitcher.
356.—Fly ball to right field and makes the catch, nobody moves.
366.—Inside, ball.
444.—Deep into center field, going back, going back, and is a home run, a 3 runs homer.
445.—Line to the pitcher, out, throws to 2nd, safe.
446.—Time called, conference between catcher and pitcher.
455.—Deep fly to center, and makes the catch, runners tap up to 2nd and 3rd, a bad throw, runner from 2nd score, runner on 3rd.
456.—Strike called.
466.—High, ball.
555.—Bunt the ball, between 3rd and home play, is a hit, everybody safe, bases loaded.
556.—Inside, ball.
566.—Strike called.
666.—Deep long fly to center field, going, going and gone, a home run at the 411 feet mark.

RUNNERS ON 1st & 2nd, ONE OUT

111.—Deep long fly to right field, going, going and gone, a home run.
112.—High outside, ball, a pitch out but runner does not go.
113.—Rolling to ss., ball hit the runner, he is out, runners on 1st and 2nd bases.
114.—Outside ball, runners go, runner from 2nd is out to 3rd base, runner on 2nd base.
115.—Time called, batter steps out the batting box.
116.—Strike called.
122.—Bunt the ball, a perfect sacrifice play, runners on 3rd and 2nd bases.
123.—Balk, runners move to 3rd and 2nd bases.
124.—Rolling to 3rd, takes it steps on bases out, throws to 2nd, safe.
125.—Rolling to 1st, throws to 2nd, out, back to 1st, out, double play.
126.—Swing and a miss, strike.
133.—Line, base hit to left, runner from 2nd score, runners on 1st and 3rd bases.
134.—Round ball to ss., throws to 1st, out, runners on 2nd and 3rd bases.
135.—Batter steps out the batting box, time called.
136.—Foul fly to right field, and makes the catch, nobody moves.
144.—Base hit to center field, runner from 2nd score, runners on 2nd and 1st bases.
145.—Rolling to 3rd, takes it, steps on base, out. Throws to 1st, out, a double play.
146.—Strike called.
155.—Base hit to center field, throws to home play and is out. Runners on 2nd and 3rd bases.
156.—Inside, ball.
166.—Line to the pitcher, out, throws to 1st, out, a double play.
222.—Deep line to right field, ball hit the wall, runners from 2nd and 1st score, is a standup double.
223.—Outside and high ball, catcher throws to 2nd and they got him out, perfect throw.
224.—Foul fly to the left field, under the ball and makes the catch, nobody moves.
225.—Strike called.
226.—High, ball.
233.—Base hit to center, here comes the throw to home play and is out, runners on 3rd and 2nd
234.—Inside ball, the throw's to 3rd, safe.
235.—Strike called.
236.—Rolling to ss., throws to 2nd, out, goes to 1st, safe. Runners on 3rd and 1st bases
244.—Base hit to right field, runner from 2nd, score, runner from 1st is going to 3rd and is out, batter on 2nd.
245.—Outside, ball.
246.—Pitcher goes to 2nd, safe.
255.—Slow dribble to 1st, 1st baseman is left with ball in hand, infield hit. Bases loaded.
256.—Rolling to pitcher, throws to 2nd, out, back to 1st, out, double play.
266.—Swing and a miss, strike.
333.—Hard line to right field line, ball hit the wall, 2 runs scored, batter is going to 3rd, and is safe, triple.
334.—Inside, ball.
335.—Line drive to 2nd baseman and makes the catch, nobody moves.
336.—Bunt the ball, a short fly to pitcher and makes the catch.
344.—Hit and run goes, a base hit, 1 score, runners on 3rd and 1st bases.
345.—Fly ball to left field, under the ball and makes the catch. Nobody moves.
346.—Strike called.
355.—Hit by the pitch (dead ball), bases loaded.

356.—Strike called, runner goes to 3rd and is safe, stolen base. Runners on 3rd and 1st bases
366.—Rolling to ss., throws to 3rd, out. Force out.
444.—Line, base hit to right field, ball gets away between the legs, 1 run scored, runner from 1st is out to home play. Batter on 2nd base.
445.—High, ball.
446.—Rolling to 3rd, takes it, steps on base, out. Runners on 2nd and 1st bases.
455.—Deep line to center going back, going back and catch the ball. Runners tag up to 3rd and 2nd, everybody safe.
456.—Foul tip.
466.—Inside, ball.
555.—Deep long fly to left field, forget it, it is a home run.
556.—Strike called.
566.—Fly to the infield, here comes 3rd baseman and makes the catch. Nobody moves.
666.—Deep long fly to left going, going and gone, home run to the 380 feet mark. 3 runs score RUNNERS ON 2nd. & 1st., TWO OUT 111.—Hard line between right center, ball goes all the way to the wall, better turning to 2nd. going to 3rd., safe, triple. 2 runs scored.
112.—Strike called.
113.—Fly to the infield, infield fly, out.
114.—Low, ball.
115.—Rolling to 1st., takes it, steps on the bag and makes the out.
116.—Swing and a miss, strike.
122.—Line, base hit to center, runner from 2nd. score. Runner from 1st. is out at 3rd. base.
123.—High, ball.
124.—Rolling to pitcher, throws to 1st., out.
125.—Rolling to ss. throws to 2nd., force out.
126.—Strike called.
133.—Line, base hit to left, runner from 2nd. score, runners from 1st. and 2nd, bases.
134.—High, ball.
135.—Rolling to 2nd., throws to ss. force out to 2nd. base.
136.—Foul fly to 3rd. base, waiting and makes the catch.
144.—Line, base hit to right field, runners from 2nd. and 1st. score, and is a stand-up double.
145.—High line to right field, under the ball, waiting and makes the catch.
146.—Swing and a miss, strike.
155.—Slow dribble to 3rd., 3rd. baseman is left with in hand infield hit, bases loaded.
156.—Outside ball.
166.—Hard line to left, ss. jump and got the ball. What a catch, beautiful play.
222.—Deep long fly to right field, going, going and gone, 3 runs home run.
223.—Foul tip.
224.—Fly to left field. 1,2,3,4, steps backward and makes the catch.
225.—Inside, ball.
226.—Fly ball to center field, waiting and makes the catch.
233.—Hit by the pitch(dead ball) bases loaded.
234.—Rolling to ss. throws to 1st., out.
235.—Fly ball to left field, waiting and makes the catch.
236.—Low, ball.
244.—Line short to left center, 2 runs scored and is a stand-up double.
245.—Strike called.
246.—Inside, ball, runner goes, he throws to 3rd., out.
255.—Pass ball, runners move to 3rd. and 2nd. bases.
256.—Rolling to 2nd., throws to 1st., out.
266.—Line, foul ball to the bleaches.
333.—Line short to left center, ball goes one hup to the wall, 2 runs scored, and is a stand-up double.
334.—Fly ball to center field, waiting and makes the catch.
335.—Low, ball.
336.—Strike called.
344.—Line, base hit to right field, runner from 2nd. score. Runners on 3rd. and 1st. bases.
345.—Rolling to 3rd., throws to 1st., out.
346.—Fly to right field, waiting and makes the catch.
355.—Line to the left field and is a foul ball.
356.—Outside, ball.
366.—Fly to infield, ss. calls for it and makes the out.
444.—Line, hard line to right field line, ball hit the wall, 2 runs scored and runner goes for 3, is triple.
445.—Foul fly to the stand.
446.—Round ball to 1st., infield hit. Bases loaded.
455.—Swing and a miss, strike.
456.—Short up to 3rd., takes it, throws to 1st., out.
466.—Slow rolling to pitcher, throws to 1st., out.
555.—Deep long fly to right center, ball goes all the way to the wall, 2 runs scored. Runner trying for 3rd. and is safe, triple.
556.—Outside, ball.
566.—Strike called.
666.—Long fly to left field. Forget it, 3 runs homer, home run.

RUNNERS ON 1st. & 3rd., NOBODY OUT

111.—Line short to left field line, ball goes to the wall, runner from 2nd. score, is a double Runners on 2nd. and 3rd.
112.—High, ball.
113.—Line to 2nd. baseman and makes the out. Runner does not move.
114.—Pitcher steps out the pitching box.
115.—Fly ball to center field and makes the catch. Runner tag up to 3rd., safe. Runners on 1st. and 3rd. bases.
116.—Strike called.
122.—Base hit to right field. The throw's to home play, out. Runners move to 2nd. and 3rd. bases.
123.—Outside, ball.
124.—Line to 2nd. baseman, out, throws to ss., double play.
125.—Fly to the infield, infield fly out.
126.—Round ball to ss., throws to 2nd., out, goes to 1st., double play. Runner from 2nd. goes to 3rd. base.
133.—Line, base hit to center, runner from 2nd. score, runners on 1st. and 3rd.
134.—Swing and a miss, strike.
135.—Inside, ball.
136.—Outside ball, catcher goes to first and he got him out.
144.—Line drive to left field, base hit, runner from 2nd. score, runner from 1st. is out in 3rd base.
145.—Strike called, runners go. Runner from 2nd is out in 3rd., runner from 1st. goes to 2nd. base.
146.—Strike called.
155.—A wild pitch, runners move to 3rd. and 2nd. bases.

156.—They calling in another pitcher.
166.—Inside, ball.
222.—Line to right field line, ball goes all the way to the wall, 2 runners score. A stand-up double.
223.—Hit by the pitch, bases loaded.
224.—Batter bunt the ball, The throw goes to 3rd. and is out.
225.—Line, foul ball to the left field stand.
226.—Strike called.
233.—Base hit to the left field, runner from 2nd. score, runner from 1st. is out in 3rd. base runner on 1st.
234.—Wild pitch, runners move to 3rd. and 2nd. bases.
235.—Fly ball to left field, waiting and makes the catch. Runners do not move.
236.—Rolling to 1st., throws to 2nd., out, back to 1st., double play, runner on 3rd. base.
244.—Hit by the pitcher, bases loaded, no one out.
245.—Bunt the ball, a short fly to pitcher, throws to 2nd., out, double play, runner on 1st. base
246.—Rolling to ss., throws to 3rd., force out.
255.—Pitcher goes to 2nd., safe.
256.—Swing and a miss, strike. Catcher throws to 2nd and they got him out, runner on 1st base
266.—Fly to right field, out-runner tag up to 3rd, safe, runners on 3rd and 1st bases.
333.—Line short to right center, ball goes all the way to the wall, trying for 3rd and is a triple, 2 runners score.
334.—Rolling to 3rd, throws to 2nd, put to 1st, double play, runner on 3rd base.
335.—Strike called.
336.—Foul fly to catcher, under the ball waiting and makes the catch.
344.—Slow rolling to 3rd, 3rd baseman is left with ball in hands. Everybody safe.
345.—Bunt the ball, a perfect bunt, everybody safe, bases loaded.
346.—Rolling to the pitcher, throws to 2nd, out, to 1st, out, a double play, runner on 3rd.
355.—They calling a new pitcher.
356.—Fly ball to right field and makes the catch. Nobody moves.
366.—Inside, ball.
444.—Deep into center field, going back, going and is a home run, 3 runs homer.
445.—Line to the pitcher out, throws to 2nd, safe.
446.—Time called, conference between pitcher and catcher.
466.—High, ball.
555.—Bunt the ball, between 3rd and home play is a hit, everybody safe, bases loaded.
556.—Inside, ball.
666.—Deep long fly to center field, going, going and gone, a home to the 441 feet mark.

RUNNERS ON 1st & 3rd, ONE OUT

111.—Line shot to left field, ball goes 1 hup to the wall, 2 runs scored, a stand-up double.
112.—Inside, ball.
113.—Swing and a miss, strike, runner goes to 2nd, the throw goes to 3rd and is out.
114.—Strike called.
115.—High ball, catcher throws to 3rd, safe.
116.—High foul fly to the catcher, under the ball and makes the out.
122.—Base hit to center field, runner from 3rd score, runners on 1st and 2nd.
123.—Round ball to 3rd, hold runner, throws to 2nd, out, runners on 1st and 3rd.
124.—Swing and a miss, strike.
125.—High fly to the infield, here comes 2nd baseman and makes the out.
126.—Outside, ball.
133.—Base hit to right field, runner from 3rd score, runner from 1st is out at 3rd base, batter moves to 2nd with the throw.
134.—Line to the pitcher and makes the out, throws to 3rd, safe.
135.—Strike called.
136.—Round ball to ss., throws to 2nd, out, to 1st, out, a double play.
144.—Base hit to center field, runner from 3rd score, runners on 1st and 2nd.
145.—High, ball.
146.—Rolling to ss., the throw goes to home play and is out, runners on 1st and 2nd.
155.—High fly to center field, waiting and makes the out, runner tag up to home play and is safe, runner from 1st does not move.
156.—Strike called.
166.—Low, ball.
222.—Deep fly to right field, going, going and gone, a home run, 3 runs scored.
223.—Outside, ball.
224.—Slow round ball to the pitcher, hold runner, throws to 1st, out, runners on 2nd and 3rd.
225.—Hard round ball to 3rd, hold runners, throws to 1st, safe, bases loaded.
226.—Strike called.
233.—Round ball to 3rd, throws to home play, out, runners on 1st and 2nd.
234.—Line shot to 2nd baseman and makes the out, nobody moves.
235.—Inside, ball.
236.—Foul fly to right field, under the ball and makes the out, nobody moves.
244.—Line, base hit to center field, 1 run scored, runners on 1st and 2nd.
245.—Fly ball to right field and makes the catch, runner from 3rd tag up, the throw to home play, safe, the runner from 1st does not move.
246.—Foul back to the stands.
255.—Outside ball, runner goes to 2nd and is safe, runner from 3rd does not move. (stolen base)
256.—Hard line to 1st baseman and makes the out, nobody moves.
266.—Low, ball.
333.—Hard line to right center, ball goes one hup to the wall, 2 runs scored, batter is going 3rd, the throw and is safe, a triple.
334.—Strike called.
335.—Fly ball to the infield, 3rd baseman calls for it and makes the out.
336.—Pitcher throws to 3rd, safe.
344.—Line, base hit to left field, 1 run scored, runners on 1st and 2nd.
345.—Pitcher throws to 1st, safe.
346.—Inside, ball.
355.—Round ball to ss., throws to 2nd, out, to 1st, out, a double play.
356.—Hard rolling to 1st, takes it, steps on the base, out, throws to home play, out, a double play.
366.—Swing and a miss, strike.
444.—Deep into left field, going, going and gone, a home run, 3 runs scored.
445.—Outside, ball.
446.—Pitcher throws to 1st, safe.

455.—Round ball to 3rd, ball goes thru the hole, a base hit, 1 run scored, runners on 1st & 2nd.
456.—High, ball.
466.—Short fly to center, looks like it is going to deep for a base hit, but fielder comes up with it, out.
555.—Deep fly to right field, going, going, ball hit the wall, 2 runs scored, batter is going to 3rd and is safe.
556.—Time called, batter steps out the batting box.
566.—Strike called.
666.—Deep line to right center, ball goes one hup to the wall and scattered between the field, 2 runs scored, batter is turning around, 3rd is going to home play, the throw and is out.

RUNNERS ON 1st & 3rd, TWO OUT

111.—Line shot to left field line, ball goes one hup to wall, 2 runs scored, a stand-up double.
112.—Inside, ball.
113.—Strike called.
114.—Fly ball to center field, waiting and makes the catch.
115.—Rolling to 2nd, takes it, throws to 1st, out.
116.—Outside, ball.
122.—Line, base hit to center field, 1 run scored, runners on 1st and 2nd.
123.—Swing and a miss, strike.
124.—Hard line to right fielder and makes the catch.
125.—Outside ball, runner goes to 2nd, the throw is bad, runner from 3rd scores, runner on 3rd.
126.—Round ball to the pitcher, takes it, throws to 1st, out.
133.—Base hit to right field, 1 run scored, runner from 1st is out on 3rd, batter moves to 2nd.
134.—Inside, ball.
135.—Hard round ball to 1st, takes it, steps on the base and makes the out.
136.—Pinch hitter comes to bat.
144.—Base hit to center field, runner from 3rd score, runners on 1st and 2nd.
145.—Swing and a miss, strike.
146.—Round ball to ss., takes it, throws to 1st, out.
155.—Strike called, runner goes to 2nd, safe, stolen base, runners on 2nd and 3rd.
156.—High, ball.
166.—Foul fly to the catcher, under the ball and makes the out.
222.—Line shot to left center, 2 runs scored and batter gets a stand-up double.
223.—Outside, ball.
224.—Strike called.
225.—Round ball to 2nd base, takes it, steps on the base and makes the out.
226.—Line drive to 1st baseman and makes the out.
233.—Hard round ball, base hit to right field, 1 run scored, runners on.
234.—Inside ball, runner goes to 2nd, the throw, safe. Stolen base, runners on 2nd and 3rd.
235.—High, ball.
236.—Round ball to 3rd, takes it, throws to 2nd, out.
244.—Base hit to left field, 1 run scored, runners on 1st and 2nd.
245.—High fly to left field, waiting and makes the out.
246.—High, ball.
255.—Hit by the pitch, dead ball, bases loaded.
256.—Slow round ball to the pitcher, takes it, throws to 1st, out.
266.—Line shot to left center, ball hit the wall, 2 runs scored, a stand-up double.
333.—Hard line to left field line, ball goes all the way to the wall, 2 runs scored, a stand-up double.
334.—Rolling to ss., takes it, throws to 1st, out.
335.—Strike called.
336.—Fly ball to right field, waiting and makes the catch.
344.—Base hit to right field, 1 run scored, runners on 1st and 2nd.
345.—Low, ball.
346.—Strike called.
355.—Wild pitch, 1 run scored, runner move to 2nd.
356.—Swing and a miss, strike.
366.—High fly to the infield, 1st baseman calls for it and makes the out.
444.—Line shot to ss. and makes the out.
445.—Line shot to ss. and makes the out.
446.—Low in the dirt, ball.
455.—Line, base hit to right field, 1 run scored, runners on 1st and 3rd.
456.—Hard line to right field and makes the catch.
466.—Foul fly to the catcher, under the ball and makes the out.
555.—Deep line to left center, ball hit the wall, 2 runs scored, batter is going to 3rd, here comes the throw and is safe.
556.—Strike called, strike out.
566.—Inside, ball 4, a walk.
666.—Deep into center field, going, going and gone, home run, 3 runs homer at the 411 feet mark.

RUNNERS ON 2nd & 3rd, NOBODY OUT

111.—Deep line to right center, ball hit the wall, 2 runs scored, batter is going to 3rd, here comes the throw and is safe, a triple.
112.—Outside, ball.
113.—Strike called.
114.—High fly to the infield, 3rd baseman calls for it and makes the out.
115.—High, ball.
116.—Pinch hitter comes to bat.
122.—Base hit to center field, 1 run scored, runner from 2nd trying to score and is out at home play. Batter moves to 2nd.
123.—Round ball to ss., takes it, holds runner, throws to 1st, out. Nobody moves.
124.—Line, foul ball to right field.
125.—They call in another pitcher.
126.—Line shot to 2nd baseman, takes it for the out, runs and steps on the base, a double play.
133.—Hit by the pitch, dead ball, bases loaded.
134.—Short fly to center field, here comes the center field running in and makes the out, nobody moves.
135.—Line shot to 3rd baseman and takes it for the out, runs and steps on base, safe.
136.—Inside ball.
144.—Base hit to left field, 2 runs scored, runner on 1st, nobody out.
145.—Swing and a miss, strike.
146.—Hard line to the pitcher, takes it for the out, throws to 3rd, out, a double play.
155.—Slow dribble to 3rd, infield hit, bases loaded.
156.—High, ball.
166.—Round ball to 3rd, throws to home play, out, runners on 1st and 3rd.
222.—Deep into left field, going, going and gone, a home run, 2 runs scored.
223.—Foul fly to the left field stand.

224.—Hard line to 3rd baseman and takes it for the out, nobody moves.
225.—High ball, catcher throws to 3rd, safe.
226.—Time called, conference between pitcher and catcher.
233.—High fly to center field and makes the catch, runners tag up, the throw to 3rd and is out. 1 run scored.
234.—Intentional walk. (4 ball).
235.—Strike called.
236.—Line shot to left field, 3rd baseman jumps and makes the out, steps on the bag, a double play.
244.—Intentional walk.
245.—Fly to the infield, 1st baseman calls for it and makes the out, nobody moves.
246—Strike called, strike out.
255.—Bunt the ball.
256.—Round ball to 2nd base, takes it, throws to home play, out, runners on 1st and 3rd.
266.—Batter steps out the batting box, time called.
333.—Base hit to right field, 2 runs scored, runner on 1st.
334.—High, ball.
335.—Swing and a miss, strike.
336.—Hard rolling to ss., ball hit the runner, he is out, runner on 1st and 3rd.
344.—Line shot to 3rd baseman, steps on base, out, throws to 2nd, out, oh my goodness, a triple play.
345.—Line shot to the pitcher, takes it for the out, nobody moves.
346.—Foul fly to the catcher, under the ball and makes the out.
355.—Base hit to left field, 1 run scored, runner from 2nd is out at home play, batter moves to 2nd with the throw.
356.—Base hit to left field, 1 run scored, runner from 2nd is out at home play, batter moves to 2nd with the throw.
366.—Pinch runner goes to run on 2nd base.
244.—Line, base hit to left center, a stand-up double, 2 runs scored.
445.—Round ball to ss., takes it, throw goes to home play and is out, runners on 1st and 3rd.
445.—Swing and a miss, strike.
455.—Time called, Conference between manager and pitcher.
456.—Inside, ball.
466.—Foul fly to right field, under the ball and makes the out, no he drops the ball.
555.—Deep line to right center, ball goes 1 hup to the wall, 2 runs scored, batter is going to 3rd and is safe, a triple.
556.—Outside, ball.
566.—Strike called.
666.—Deep fly to right center, going, going and gone, a home run at the 333 feet mark.

RUNNERS ON 2nd & 3rd, ONE OUT

111.—Line shot to 3rd base line, a fair ball, 2 runs scored, batter is going to 3rd, the throw, and is safe, a triple.
112.—Low in the dirt, ball.
113.—Fly ball to left field, takes it, out, runner tag up to home play, the throw and runner gets back to 3rd.
114.—Time called, batter steps out the batting box.
115.Batter bunts the ball, a short fly to the pitcher and takes it for the out.
116.—Strike called.
122.—Base hit to left field, 1 run scored, they hold runner on 3rd, runners on 1st and 3rd.
123.—Rolling to the pitcher, takes it, hold runner, throws to 1st, out.
124.—High, ball.
125.—Inside ball, catcher throws to 3rd and is out.
126.—Pinch hitter comes to bat.
133.—Base hit to right field, 2 runs scored, runner on 1st.
134.—Swing and a miss, strike.
135.—Pitcher throws to 2nd, safe.
136.—Batter bunts the ball, interference, batter is out.
144.—Intentional walk.
145.—Line shot to 1st baseman and takes it for the out, nobody moves.
146.—Strike called.
155.—Hit by the pitch, dead ball, bases loaded.
156.—High, ball.
166.—Fly ball to left field, waiting and makes the out, nobody moves.
222.—Round ball to 2nd, ball gets away between the legs, 2 runs scored, error, runner on 1st.
223.—Time called, conference between catcher and pitcher.
224.—Round ball to ss., takes it, throws to home play, out, runners on 1st and 3rd.
225.—Another pitcher is warming up in the bull pen.
226.—Batter bunts the ball to 3rd baseline, foul ball.
233.—Base hit to center field, 1 run scored, runner from 2nd is out in home play, batter moves to 2nd.
234.—Outside ball, catcher throws to 3rd, safe.
235.—Strike called.
236.—High fly to the infield, 1st baseman calls for it and makes the out.
244.—Batter bunts the ball, a perfect squeeze play.
245.—Rolling to the pitcher, takes it, hold runner, throws to 1st, out.
246.—Batter is thrown out of the game for saying bad words to the umpire.
255.—Fly ball to center field and makes the catch, runner tag up to home play, safe, runner on 2nd.
256.—Line shot to the pitcher and takes it for the out, throws to 3rd, safe.
266.—High foul fly to the catcher, under the ball waiting and he drops the ball.
333.—Round ball to ss., gets away, error, 1 run scored, runners on 1st and 3rd.
334.—Time called, chief umpire clean home play.
335.—Line shot to 2nd baseman and takes it for the out, nobody moves.
336.—Swing and a miss, strike.
344.—Pitcher throws to 3rd, a bad throw, 2 runs scored, bases empty.
345.—Line shot to center field and takes it for the out, nobody moves.
346.—Pitcher steps out the pitching box.
355.—Base to right field, 2 runs scored, runner on 1st.
356.—Swing and a miss, strike, batter crosses home play and is out.
366.—Intentional walk, bases loaded.
444.—Deep fly to left field, going, going and gone, a home run, 3 runs scored.
445.—Outside, ball.
446.—Line shot to ss. and takes it for the out, nobody moves.
455.—Round ball to ss., ball hit the runner, he is out, 1 run scored, runner on 1st.
456.—Strike called.

466.—Outside, ball.
555.—Deep line to left center, ball goes 1 hup to the wall, 2 runs scored, batter is going to 3rd and is safe, a triple.
556.—Line drive to 2nd baseman and makes the out, nobody moves.
566.—Swing and a miss, strike.
666.—Deep fly to left center, going, going and gone, home run, 3 runs scored.

RUNNERS ON 2nd & 3rd, TWO OUT

111.—Short fly to center field, looks like it is going to drop for a base hit, base hit, 2 runs scored, and is a double.
112.—Round ball to 2nd, takes it, throws to 1st, out.
113.—Strike called.
114.—Outside, ball.
115.—Line, foul ball to left field.
116.—Fly ball to center field, waiting and makes the catch.
122.—Base hit to right field, 2 runs scored, runner on 1st.
123.—Hard round ball to 3rd, he bobbles the ball, throws to 1st, out.
124.—High ball, runner from 3rd goes to home play and is out.
125.—Line shot to 2nd baseman and makes the out.
126.—Swing and a miss, strike.
133.—Outside ball, runner from 3rd goes to home play and is safe, runner from 2nd does not move.
134.—Inside ball.
135.—Fly ball to right field, waiting and makes the catch.
136.—Round ball in the hole to ss., takes it, a long throw to 1st, out.
144.—Pass ball, 1 run scored, runner from 2nd moves to 3rd base.
145.—Fly ball to left field. 1,2,3 steps backwards and makes the catch.
146.—Strike called.
155.—Wild pitch, but nobody moves.
156.—Slow dribble to 1st base, infield hit, 1 run scored, runners on 1st and 3rd.
166.—Round ball to the pitcher, takes it, throws to 1st, out.
222.—Base hit to center field, 2 runs scored, runner on 1st.
223.—Fly ball to right field, waiting and makes the catch.
224.—Swing and a miss, strike out.
225.—Fly ball to the left field, waiting and makes the catch.
226.—Rolling to the pitcher, takes it, hold runner, throws to 1st, out.
233.—Base hit to center field, 1 run scored, runner from 2nd goes to home play, the throw and is out.
234.—High, ball.
235.—Line shot, 1st base, and makes the out.
236.—Foul ball to right line, here comes the right fielder and makes the out.
244.—Line shot to left field line, fair ball, ball goes all the way to the wall, 2 runs scored and is a stand-up double.
245.—Strike called, catcher throws to 2nd base, safe.
246.—Outside, ball.
255.—Base hit to right field, 2 runs scored, runner on 1st.
256.—Swing and a miss, strike.
266.—Line shot to 2nd baseman and makes the out.
333.—Intentional walk, bases loaded.
334.—Low, ball.
335.—Round ball to 3rd, takes it, throws to 1st, out.
336.—Foul ball to right field line.
344.—Line shot, base hit to center field, 2 runs scored, runner on 1st.
345.—Strike called.
346.—Low in the dirt, ball.
355.—Line shot to left field, ss. jumps and makes a beautiful catch, out.
356.—High foul ball to 3rd base, under the ball waiting and makes the out.
366.—Outside, ball.
444.—Deep line to right center, ball goes 1 hup to the wall, 2 runs scored, batter is going to 3rd and is safe, a triple.
445.—High, ball.
446.—Line shot to 3rd and makes the out.
455.—Line, base hit to left field, 2 runs scored, runner on 1st.
456.—Round ball to ss., takes it, throws to 1st, out.
466.—Strike called.
555.—Deep line to center field, going, going, ball hit the wall, 2 runs scored and is a stand-up triple.
556.—Strike called, strike out.
556.—Low, ball.
666.—Hard line to 3rd base, fair ball, 2 runs scored, batter is going to 3rd, here comes the throw and is safe, a triple.

BASES LOADED, NOBODY OUT

111.—Deep fly to left field, going, going and gone, a grand slam, a home run at the 385 feet mark.
112.—Time called, batter steps out the batting box.
113.—Strike called, strike out.
114.—They call in another pitcher.
115.—Line shot to 3rd base, takes it, runs and steps on the bag, a double play.
116.—Fly to the infield, infield fly, out.
122.—Base hit to center field, 2 runs scored, runner from 1st is out at 3rd base, runner on 1st.
123.—Round ball to ss, takes it, throws to 2nd, out, to 1st, out, a double play, 1 run scored.
124.—Infield close in.
125.—Rolling to the pitcher, takes it, throws to home play, out, to 1st, safe, bases remain loaded.
126.—Inside ball, catcher throws to 3rd, out.
133.—Base hit to left field, 2 runs scored, runners on 1st and 2nd.
134.—High, ball.
135.—Line shot to the pitcher and makes the out, nobody moves.
136.—Pinch hitter comes to bat.
144.—A walk, 1 run scored.
145.—Swing and a miss, strike.
146.—Fly ball to left field and makes the catch, runner tag up to home play and is safe, runners on 1st and 2nd.
155.—Line to right field line, a fair ball, 2 runs scored, a stand-up double, runners on 2nd & 3rd.
156.—Foul fly to the catcher, under the ball, waiting and makes the catch.
166.—Swing and a miss, strike.
222.—Base hit to left field line, ball goes all the way to the wall, 2 runs scored, runners on 2nd and 3rd, a stand-up double.
223.—Foul tip, hit the catcher.

224.—Outside ball, catcher throws to 3rd, safe.
225.—Pitcher steps out the pitching box.
226.—Strike called.
233.—Slow dribble to 3rd base, throws at home play, safe, infield hit, bases loaded.
234.—High, ball.
235.—Round ball to the pitcher, takes it, throws to home play and is out, bases loaded.
236.—Time called, conference between pitcher and catcher.
244.—Base hit to right field, 2 runs scored, runners on 1st and 2nd.
245.—Strike called.
246.—Time out, conference in the pitching box between manager and pitcher.
255.—Slow round ball to ss., infield hit, 1 run scored, bases remain loaded.
256.—Foul fly to right field and makes the catch, runner tag up to home play and is safe, runner on 1st and 2nd.
266.—Round ball to 3rd base line, interference, out, bases remain loaded.
333.—Deep line to right center, ball hit the wall, 2 runs scored, a stand-up double, runners on 2nd and 3rd.
334.—Time called, manager goes to talk to the pitcher.
335.—Outside, ball.
336.—Swing and a miss, strike.
344.—Wild pitch, 1 run scored, runners move to 2nd and 3rd.
345.—Short fly to left field and makes the catch, nobody move.
346.—High, ball.
355.—Hit by the pitch, dead ball, 1 run scored, bases remain loaded.
356.—Outside, ball.
366.—High ball, catcher throws to 3rd base and they got him out.
444.—Line shot to right center, ball goes 1 hup to the wall, 3 runs scored, batter is going to 3rd and is safe, a triple.
445.—Line shot to ss. and makes the out, nobody moves.
446.—Strike called.
455.—Batter bunts the ball, surprise everybody, infield hit, 1 run scored, bases loaded.
456.—Foul fly to the catcher, under the ball and he drops the ball.
466.—Hard line to 3rd base, takes it for the out.
555.—Deep fly to center field, going, going and gone, a grand slam at the 411 feet mark, 4 runs scored.
556.—High, ball.
566.—Line shot to 3rd baseman, takes it for the out, steps on the bag, safe.
666.—Line hard shot to 3rd baseman, takes it for the out, steps on the bag, out, throws to 2nd base, a triple play. What a tremendous play by the 3rd baseman, listen to that crowd.

BASES LOADED, ONE OUT

111.—Deep fly to left field, going, going, and gone, a grand slam, 4 runs scored.
112.—Chopped to the home play, fair ball, catcher takes it, step into home play, out throws at 1st., a double play.
113.—Strike called.
114.—A hard line to the pitcher, he drops it, takes it, throws to 1st., out, 1 run scored.
115.—Pinch runner, comes to run on 2nd. base.
116.—Pitcher goes to 1st., safe.
122.—Line, base hit to center field, 2 runs scored, runners on 1st. and 2nd. bases.
123.—High, ball, runner goes to home play and is out, runners do not move.
124.—Round ball to 1st., throws to home play, out, bases remain loaded.
125.—Fly to the infield, infield fly.
126.—Round ball to ss., throws to home play, out, force out.
133.—Round ball to 2nd., ball goes thru for a base hit, 2 runs scored, runners on 1st. and 2nd.
134.—Time calls.
135.—Strike called, conference with the whole infield.
136.—Fly ball to left field, waiting and makes the out.
144.—A hard line to right field, base hit, the throw's to home play, safe, 2 score, runners on 2nd. and 3rd. bases.
145.—A pitcher is waiting up in the bull pen.
145.—Swing and a miss, strike.
155.—Base hit to left field, 2 runs scored. Runners on 1st. and 2nd. bases.
156.—Pinch batter comes to bat.
166.—Foul fly to 1st., under the ball and makes the out. Nobody moves.
222.—Line short to left field line, ball goes one hup to the wall, a stand-up double, 2 runs scored.
223.—Line short to left field and makes the out, runners do not move on 2nd. and 3rd. bases.
224.—Round ball to 3rd., throws to home play, out.
225.—Foul fly to catcher, under the ball and makes the out.
226.—Strike called, strike out.
233.—Line, base hit to right field, the throw's to home play, safe, 2 runs scored, runners on 1st and 3rd. bases.
234.—Short line to center field, base hit, here comes the throws to home play and runner from 2nd. is out, 1 run scored, runners on 1st. and 2nd. bases.
235.—Short fly to center field, here comes the center field and makes the out. Nobody moves.
236.—Batter steps out of the batting box.
244.—A walk, 4 balls, 1 run scored.
245.—Line short to 2nd. baseman and he makes the out, runners do not move.
246.—High ball.
255.—Batter bunt the ball, a perfect squeeze play.
256.—Strike called.
266.—Deep fly to right field, going, going and field jump and makes the catch, runners tag up and everybody safe, 1 run scored.
333.—Line short to left field line, ball goes all the way to the wall, 2 runs scored. A standup double, runners on 2nd. and 3rd. bases.
334.—Short fly to 2nd. and he makes the out. Runners do not advance.
335.—Wild pitch, runners advance. 1 run scored, runners on 2nd. and 3rd. bases.
336.—Swing and a miss, strike.
344.—Line short to center field, base hit. 2 runs scored, runners on 2nd. and 3rd. bases.
345.—Line, foul ball to the right field line.
346.—Hard round ball, ss. throws to 2nd., out, to 1st., out. A double play.
355.—Base hit to short center, 1 run scored. Bases loaded.
356.—Pitcher goes to 3rd. base, out. They got him.
366.—Outside ball, runner goes to home play and is safe. 1 run scored, stolen base.

444.—Deep into right field going, going and gone. A grand slam, 4 runs scored.
445.—Rolling to the pitcher, takes it and throws to home play, out, to 1st., safe.
446.—Strike called.
455.—They calling in another pitcher.
456.—High ball.
466.—Line short to 3rd. baseman and he makes the out. Nobody moves.
555.—Deep line to right center, ball hit the wall, 3 runs scored. Trying for 3 and safe, a triple.
556.—Inside ball.
566.—Strike called, strike out.
666.—Deep fly to left field, going, going and gone. A grand slam, 4 runs scored.

BASES LOADED, TWO OUTS

111.—Deep fly to left field going, going and gone. A grand slam, 4 runs scored.
112.—Low and outside, ball.
113.—Round ball to 1st., throws to the pitcher, out.
114.—Swing and a miss, strike out.
115.—Runner goes to home play, high outside ball, and is safe.
116.—Chopeed to home play, a fair ball. Catcher takes it, step on home play, out.
122.—Round ball to 3rd., goes thru to left field. Runner from 1st. is going to 3rd. and is out. Two runs scored.
123.—Rolling to ss., takes it, throws to 1st., is out.
124.—Line drive to the 2nd. baseman's and makes the out.
125.—High, ball.
126.—Swing and a miss, strike.
133.—Short fly to center field, makes the catch, out.
134.—Fly ball to the infield, 2nd. baseman calls for it and makes the out.
135.—Line short to 3rd., and makes the out.
136.—Pinch batter comes to bat.
144.—A walk, one score.
145.—Strike called.
146.—A hard rolling to 3rd., takes it and throws to 1st., out.
155.—Line, base hit to right field, 2 runs scored. Runners on 1st. and 2nd. bases.
156.—Round ball to the pitcher, throws to 1st., out.
166.—High and inside, ball.
222.—Batter bunt the ball, a perfect squeeze play.
223.—Foul fly to left field, here comes left field and makes the catch.
224.—Low, ball.
225.—Batter steps out the batting box.
226.—Line short to center field and makes the out.
233.—Slow dribble to the pitcher, throws to 1st., safe, 1 run scored, bases loaded.
234.—Inside, ball.
235.—Pitcher goes to 3rd., safe.
236.—Swing and a miss, strike.
244.—Line, to left field line, ball goes one hup to the wall, a stand-up double and 2 runs scored.
245.—Time out, conference between pitcher and catcher.
246.—Line short to right field and makes the catch.
255.—High and outside ball, runner goes to home play and is safe, 1 run scored, stolen base.
256.Swing and a miss, strike.
266.—High foul fly to 3rd. base, under ball waiting and he drops the ball.
333.—Line to right field line, ball goes all the way to the wall. 2 runs scored. A stand-up double.
334.—Line drive to left field line, here comes the left field and makes the catch. What a catch.
335.—Line, Foul ball to right field.
336.—Outside, ball.
344.—Round ball up the middle to center field, base hit, 2 runs scored. Runners on 1st. and 2nd. bases.
345.—Strike called.
346.—Foul fly to right field line, here comes the right field and makes the catch.
355.—Slow dribble to 3rd. base, infield hit, bases loaded, 1 run scored.
356.-Fly ball to center field and makes the catch.
366.—Rolling in the hole, ss. takes it, no he drops it, everybody safe, runner for 3rd. scores. Bases loaded. (error).
444.—Deep into left field, going, going and gone, a grand slam, 4 runs scored.
445.—Rolling to the pitcher, takes it, throws to 1st., out.
446.—Deep to right field, a foul ball.
455.—Pass ball, runners advance, 1 run scored.
456.—Strike called.
466.—Fly ball to right field, under the ball and makes the out.
555.—Hard line to right center, ball hit the wall and scattered to right field, 3rd. runs, score, a stand-up triple.
556.—Fly to left field, under the ball and makes the out.
566.—Swing and a miss, strike.
666.—Deep into center field, going, going and gone, a grand slam, 4 runs scored.

I claim:

1. A game comprising:
a game board, a baseball diamond formed on the game board;
a plurality of playing pieces distinctively identified to form two teams of individual baseball players;
a scoring pad;
chance determining means for producing a random output count in positive integers each integer being a number in a base seven system;
table lookup means for providing specified game information corresponding to each output count, said table lookup means comprising a separate table for each combination of the number of outs in an inning and the number of runners on base;
and computer means for storing said tables, said computer means having a first input for entering said output count into the computer, a second input for entering the number of outs, the number of runners on base, and the number of innings, and display means for displaying the specified information corresponding to the output number entered and the number of outs and runners on base.

2. A game as in claim 1, wherein said chance determining means comprises a plurality of individual gaming pieces, and wherein said output count always has a corresponding plurality of digits.

3. A game as in claim 2, wherein said gaming pieces are dice.

4. A game as in claim 3, and comprising three dice.

5. A game as in claim 1, wherein said scoring pad comprises means for recording the total and type of hits per game by each player, and for determining total records of the team and the players.

6. A game as in claim 1, and comprising 23 individual tables representing 23 possible conditions during an inning, and a total of 56 individual output counts on each table, representing the combination of three digits in the base seven system.

7. A game as in claim 1, and wherein each playing piece of each of said respective teams has a respective configuration corresponding to a particular type of baseball player.

* * * * *